United States Patent [19]

Hewson

[11] Patent Number: 4,940,155

[45] Date of Patent: Jul. 10, 1990

[54] COLLAPSIBLE CONTAINER

[76] Inventor: Kenneth E. Hewson, 4884 Hardwoods Dr., West Bloomfield, Mich. 48033

[21] Appl. No.: 167,880

[22] Filed: Mar. 14, 1988

[51] Int. Cl.[5] ..... B65D 6/18

[52] U.S. Cl. ..... 220/6; 220/340; 220/337; 206/600

[58] Field of Search ..... 190/107; 220/6, 7, 340, 220/337, 341, 69; 206/599, 600

[56] References Cited

U.S. PATENT DOCUMENTS

| | | | |
|---|---|---|---|
| 1,422,692 | 7/1922 | Gibbons . | |
| 1,769,019 | 7/1930 | Flagstad . | |
| 2,486,532 | 11/1949 | Kubach | 220/6 |
| 2,512,522 | 6/1950 | Denny | 220/6 |
| 2,517,178 | 8/1950 | Cheatham, Jr. | 220/7 X |
| 2,558,126 | 6/1951 | Davenport | 220/6 |
| 2,785,823 | 3/1957 | Zarges | 220/6 |
| 3,186,585 | 6/1965 | Denny | 220/97 |
| 3,424,365 | 1/1969 | Venturi | 220/6 X |
| 3,782,579 | 1/1974 | Zarges | 220/6 X |
| 3,796,342 | 3/1974 | Sanders et al. | 220/6 |
| 3,870,185 | 3/1975 | Sanders | 220/6 |
| 3,941,271 | 3/1976 | Zarges et al. | 220/6 |
| 3,973,692 | 8/1976 | Cloyd | 220/7 |
| 4,062,467 | 12/1977 | Friedrich | 220/7 |
| 4,163,495 | 8/1979 | Drader | 220/6 X |
| 4,181,236 | 1/1980 | Prodel | 220/7 X |
| 4,624,381 | 11/1986 | Friedrich | 220/7 |
| 4,674,647 | 6/1987 | Gyenge et al. | 220/6 |
| 4,717,214 | 1/1988 | Moore et al. | 220/7 X |

FOREIGN PATENT DOCUMENTS

| | | | |
|---|---|---|---|
| 1048423 | 2/1979 | Canada | 190/10.4 |
| 1494178 | 7/1967 | France | 70/203 |

*Primary Examiner*—Frankie L. Stinson

*Attorney, Agent, or Firm*—Basile and Hanlon

[57] ABSTRACT

The collapsible container includes a rectangular bottom wall, two opposed vertical side walls, two opposed vertical end walls, hinge means for pivotally and releasably attaching the side and end walls to the bottom wall, and means for locking the side and end walls in an erected position. The hinge means preferably includes a first wall having a first hinge portion with an integrally formed pivot pin adjacent a bottom edge and a second wall having a cooperating second hinge portion with an integrally formed, semi-cylindrical surface. Preferably the second hinge portion further includes an integrally formed projection disposed adjacent the semi-cylindrical surface spaced along a periphery of the second wall. The projection is movable out of axial alignment with the semi-cylindrical surface to permit insertion of the pivot pin and returnable into axial alignment with the semi-cylindrical surface to releasably secure the first wall in pivotal relation to the second wall. The corner joint locking means preferably includes the side wall having a groove formed on an exterior surface adjacent a vertically extending edge and the end wall having a flange extending generally parallel with the side wall. A second flange extends inwardly from the first flange and is engageable within the groove. A third flange having a surface generally parallel to the second flange engages a corner edge of the side wall with a ridge formed on the surface to releasably lock the side and end walls in the erected position.

19 Claims, 3 Drawing Sheets

COLLAPSIBLE CONTAINER

BACKGROUND OF THE INVENTION

I. Field of the Invention

The invention relates to containers for storage and handling of products and, more particularly, to a container which can be collapsed when not in use.

II. Description of the Prior Art

Generally speaking, various configurations of collapsible types of containers are known in the art. For example, see U.S. Pat. Nos. 4,062,467; 3,796,342; 3,186,585; 2,558,126; 2,512,522; 2,486,532; 1,769,019; 1,422,692; Canadian Patent No. 1,048,423; and French Patent No. 1,494,178. Generally speaking, these prior art containers have complex hinge constructions, which require the insertion of a separate pivot pin into aligned cylindrical bores. This construction of the hinge increases the cost of production and assembly for the containers. In addition, the various configurations of the collapsible corner joints generally lack sufficient strength and resistance to unlocking movement.

Therefore, it is desirable in the present invention to form the hinge portions of the container as integral parts of the walls, thereby eliminating the additional cost of production and assembly inherent in having to insert a separate pin through aligned cylindrical apertures. In addition, it is desirable to form a corner joint integral with the side walls to provide increased strength at the joint along the vertically extending edge and to provide greater resistance against unlocking movement of the walls with respect to one another.

SUMMARY OF THE INVENTION

A collapsible container is disclosed having a rectangular bottom wall, two opposed vertical side walls, two opposed vertical end walls, hinge means for pivotally and releasably attaching the side and end walls to the bottom wall, and means for locking the side and end walls in an erected position. The side and end walls are pivotable between an erected position generally perpendicular to the bottom wall and a collapsed position generally parallel and overlying the bottom wall. The improvement of the hinge means includes a first one of the walls having a first hinge portion with an integrally formed pivot pin adjacent an edge and a second one of the walls having a corresponding cooperating second hinge portion, adjacent the first hinge portion, with an integrally formed, semi-cylindrical surface. The semi-cylindrical surface defines an aperture of sufficient size to allow the pivot pin to pass through the aperture into engagement with the semi-cylindrical surface. In addition, or in the alternative, the improvement of the locking means includes the side wall having a groove formed on an exterior surface adjacent a vertically extending edge and the end wall having a flange extending generally parallel with the side wall. A second flange extends inwardly and is engageable within the groove of the side wall. A third flange, having a surface generally parallel to the second flange, engages a corner edge of the side wall with a ridge formed on the surface to releasably lock the side and end walls in the erected position.

BRIEF DESCRIPTION OF THE DRAWINGS

The accompanying description refers to the drawings wherein like reference numerals refer to like parts throughout the several reviews, and wherein.

DESCRIPTION OF THE PREFERRED EMBODIMENTS

Figure 1:
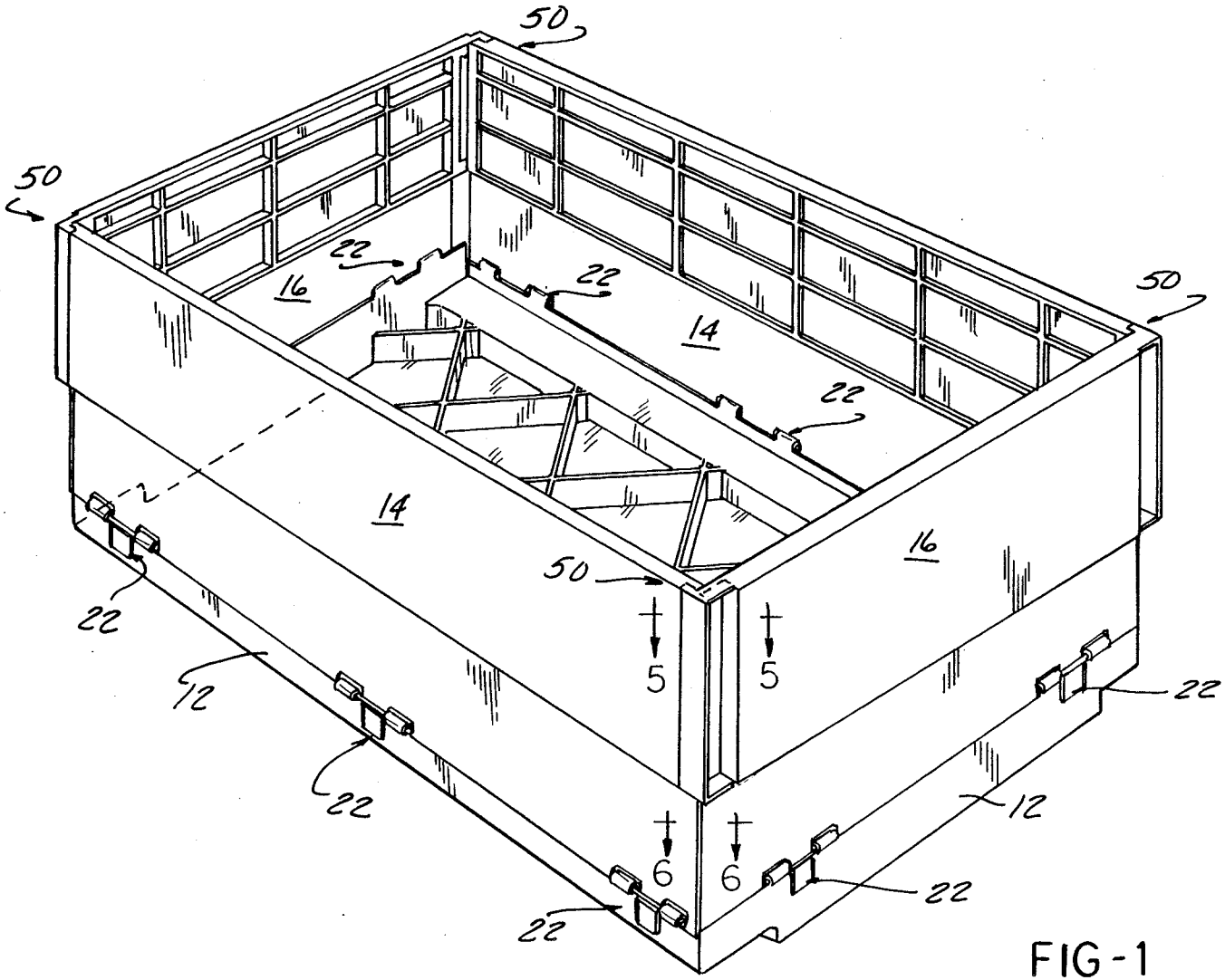
FIG. 1 is a perspective view of a collapsible container according to the present invention.

The collapsible container, designated generally as 10 in FIG. 1, includes a base or bottom wall 12, two opposing side walls 14 and two opposing end walls 16, generally designated as vertical walls 18 when referring to either a side wall 14 or an end wall 16. The collapsible container 10 has hinge means 22 disposed between the vertical walls 18 and the bottom wall 12. Means 50 between the side wall 14 and the end wall 16 are provided for locking the collapsible container in an erected position.

Figure 2:
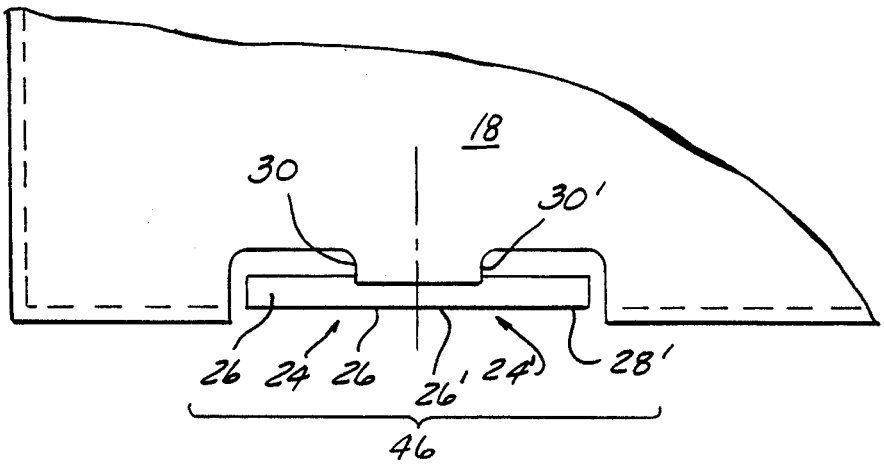
FIG. 2 is a partial view of a vertical wall showing a first hinge portion.

Referring now to FIG. 2, the hinge means 22 includes a first hinge portion 24 having a pivot pin 26 integrally formed with a vertical wall 18 adjacent a bottom edge. The pivot pin 26 includes a cylindrical projection 28 extending outwardly, generally parallel to the bottom edge, and is connected with the vertical wall 18 by a tab 30. Preferably, the first hinge portion 24 includes a double pivot pin configuration 46, wherein the first hinge portion 24 is symmetrical about its centerline having a mirror image designated by pivot pin 26', cylindrical projection 28' and integrally formed connecting tab 30'.

Figure 3:
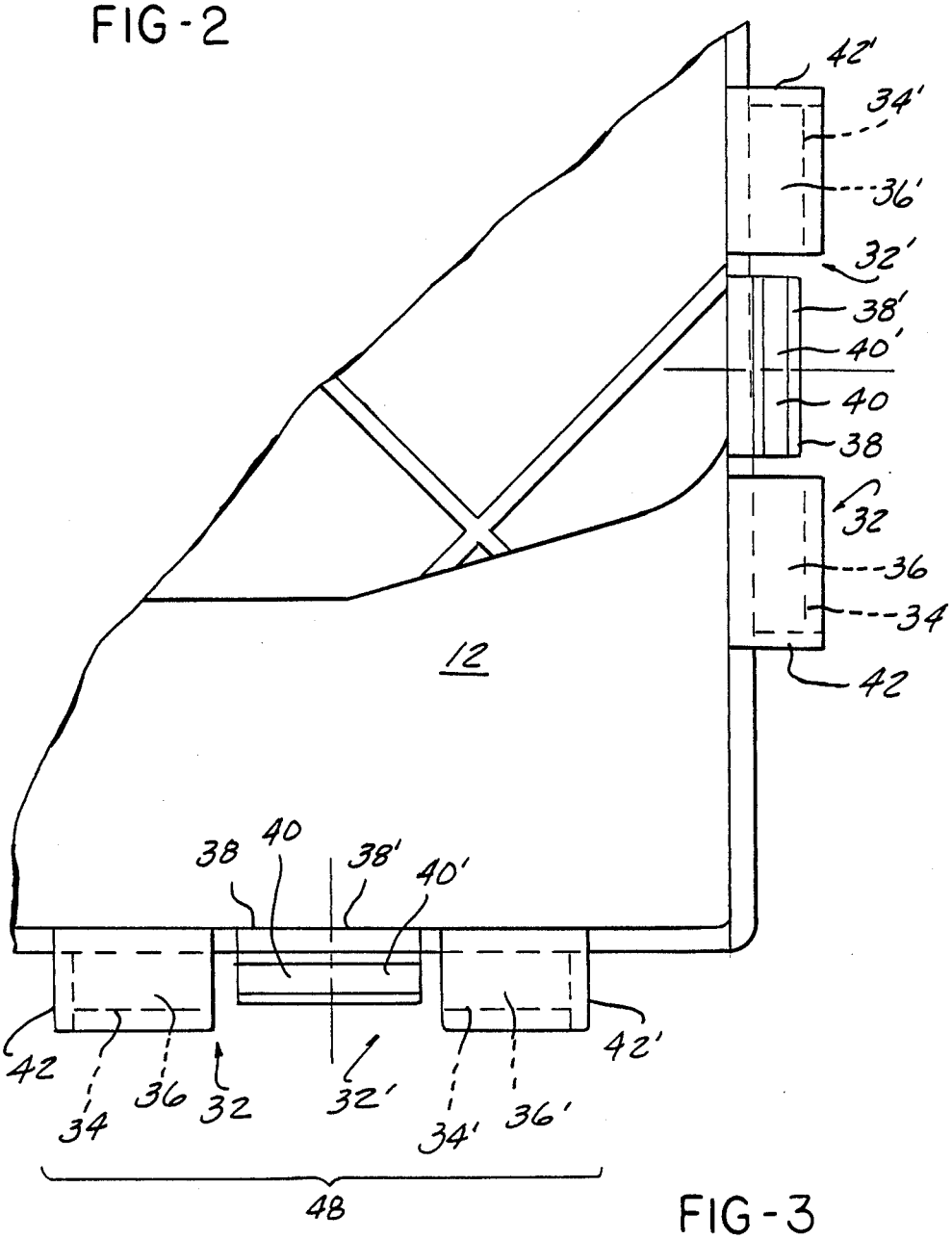
FIG. 3 is a partial plan view of a bottom wall showing a second hinge portion.
Figure 4:
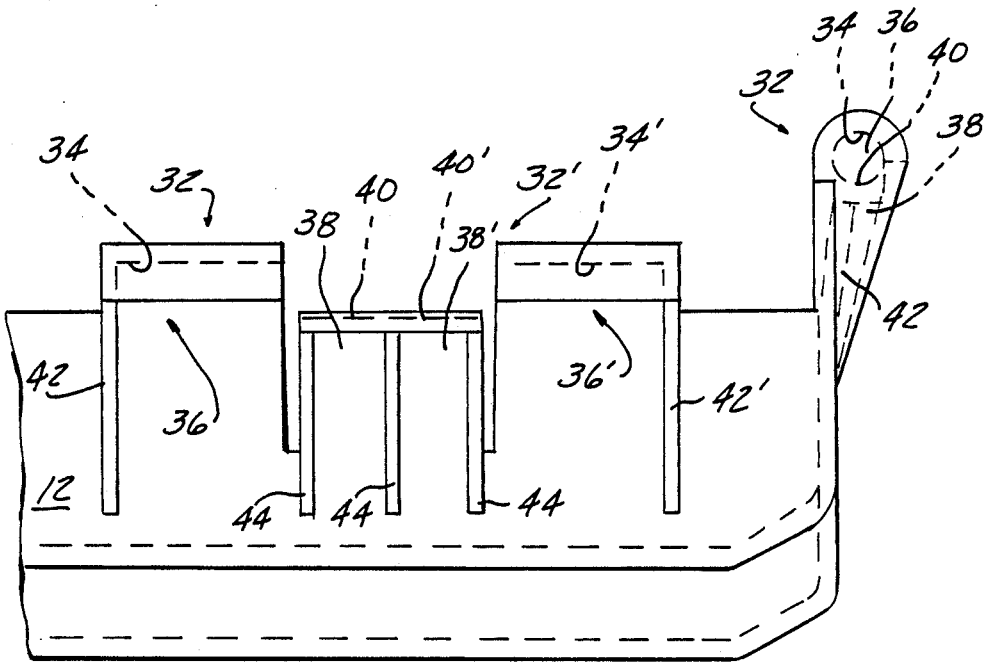
FIG. 4 is a partial side view of the bottom wall showing the second hinge portion.

FIG. 3 shows a partial plan view of the bottom wall 12 including a second hinge portion 32 of the hinge means 22. The second hinge portion 32 includes an integrally formed, semi-cylindrical surface 34. The open portion of the cylindrical periphery defines a pin-receiving aperture 36, wherein the cylindrical projection 28 of the first hinge portion 24 can be inserted along a radial path of travel through the pin-receiving aperture 36 to contact the semi-cylindrical surface 34 of the second hinge portion 32 integrally formed with the bottom wall 12. Preferably, the second hinge portion 32 also includes a projection 38 spaced along the periphery of the bottom wall 12 from the semi-cylindrical surface 34. Preferably, the projection 38 has a curved surface 40 which is coaxial with the semi-cylindrical surface 34, such that the semi-cylindrical surface 34 forms one portion of the pin-receiving aperture 36 and the curved surface 40 forms an opposing surface of the pin-receiving aperture 36, as can be seen in FIG. 4. The projection 38 is flexible or movable out of axial alignment with the semi-cylindrical surface 34 to permit insertion of the cylindrical projection 28 of the first hinge portion 24. The projection 38 can then be moved back into axial alignment with the semi-cylindrical surface to releasably lock the cylindrical projection 28 in engagement with the semi-cylindrical surface 34 to allow pivotal movement of the vertical wall 18 with respect to the bottom wall 12. Preferably, the second hinge portion 32 includes first stiffening webs 42 on an end of the integrally formed, semi-cylindrical surface 34. The projection 38 also preferably includes second stiffening webs 44 to strengthen the projection against fatigue due to its flexing movement into and out of coaxial alignment with the semi-cylindrical surface 34. The second hinge portion 32 is preferably formed having a double semi-cylindrical configuration 48, such that the second hinge portion 32 is symmetrical about its centerline with a mirror image designated by second hinge portion 32', semi-cylindrical surface 34', pin-receiving aperture 36', projection 38', curved surface 40', first stiffening web 42' and second stiffening web 44' for engagement with the preferred double pivot pin configuration 46 of the first hinge portion 24.

The configuration described above includes the first hinge portion 24 integrally formed on the vertical wall 18 and the second hinge portion 32 integrally formed on the bottom wall 12. It should be recognized that this is a preferred configuration of the invention, and that forming the first hinge portion 24 on the bottom wall 12 and the second hinge portion 32 on the vertical wall 18 is within the disclosure of the present invention and scope of the appended claims.

Figure 5:
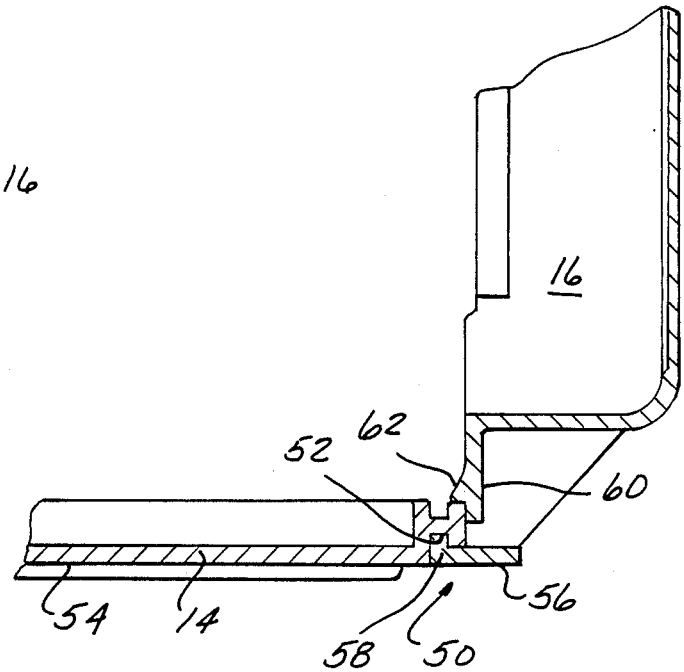
FIG. 5 is a cross-sectional view of an upper portion of a corner joint between two vertical walls showing a means for locking.

FIG. 5 is a cross-sectional view of an upper portion of a corner joint between the side and end walls, 14 and 16 respectively, showing the means for locking 50. The means for locking 50 includes a groove 52 formed on an exterior surface 54 of the side wall 14. The end wall 16 has a first flange 56 generally parallel and coplaner with the side wall 14. A second flange 58 extends inwardly from the first flange 56 and is engageable within the groove 52. A third flange 60 also formed integrally with the end wall 16 extends generally parallel to the second flange 58 and engages against the outward edge of the side wall 14. A ridge 62 is formed on the third flange 60 and engages a corner edge of the side wall 14 to releasably secure the second flange 58 within the groove 52 to releasably lock the corner joint between the side wall 14 and end wall 16 in an erected position. Preferably, the locking means 50 extends along the upper portion of the corner joint for between approximately $\frac{1}{3}$ to approximately $\frac{1}{2}$ of the length of the corner joint.

Figure 6:
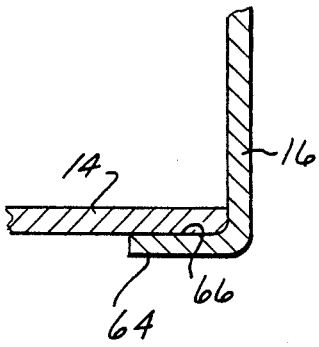
FIG. 6 is a cross-sectional view of a lower portion of a corner joint between the vertical walls.

FIG. 6 is a cross-sectional view of a lower portion of the corner joint between the side and end walls, 14 and 16 respectively. A fourth flange 64 is integrally formed with the end wall 16 and is generally parallel to the side wall 14. The side wall 14 abuts against an interior surface 66 of the fourth flange 64 to prevent outward bulging of the side wall 14 beyond the end wall 16 along the lower portion of the corner joint.

Although the best mode contemplated for carrying out the present invention has been herein shown and described, it will be apparent that modification and variation may be made without departing from what is regarded to be the subject matter of the invention herein according to the scope of the appended claims.

What is claimed is:

1. A collapsible container comprising:

a rectangular bottom wall;

two opposed vertical side walls;

two opposed vertical end walls;

hinge means for pivotally and releasably attaching said side and end walls to said bottom wall, said side and end walls pivotable between an erected position generally perpendicular to said bottom wall and a collapsed position generally parallel to and overlying said bottom wall, said hinge means including a first one of said walls having a first hinge portion with an integrally formed pivot pin adjacent an edge and a second one of said walls having a cooperating second hinge portion, adjacent said first hinge portion, with an integrally formed, semi-cylindrical surface, said semi-cylindrical surface defining an aperture of sufficient size to allow said pivot pin to pass radially through said aperture into engagement with said semi-cylindrical surface, wherein said second hinge portion further includes an integrally formed projection disposed adjacent said semi-cylindrical surface along a periphery of said second one of said walls, said projection movable out of axial alignment with said semi-cylindrical surface to permit insertion of said pivot pin and returnable into axial alignment with said semi-cylindrical surface to releasably secure said first one of said walls in pivotal relation to said second one of said walls; and means for locking said side and end walls in said erected position.

2. The collapsible container of claim 1, wherein said projection further comprises:

a curved surface on said projection radially opposite from said semi-cylindrical surface and longitudinally spaced along said periphery of said second one of said walls from said semi-cylindrical surface, said curved surface and semi-cylindrical surface defining a pivot-pin-receiving aperture.

3. The collapsible container of claim 1, wherein said means for locking further comprises corner joint means for locking said side and end walls in said erected position, said corner joint means including each said side wall having a groove formed on an exterior surface adjacent a vertically extending edge and each said end wall having a first flange extending generally parallel with said side wall, a second flange extending outwardly from said first flange and engagable within said groove, and a third flange having a surface generally parallel to said second flange engaging a corner edge of said side wall with a ridge formed on said surface to releasably lock said side and end walls in said erected position.

4. The collapsible container of claim 3, wherein said groove, second flange and ridge extend along at most an upper half of said vertically extending edge.

5. The collapsible container of claim 4, further comprising:

a remaining lower portion of said vertically extending edge having a fourth flange formed on said end wall extending generally parallel to said side wall wherein said side wall abuts against an interior surface of said fourth flange to prevent outward bulging of said remaining lower portion of said side wall beyond said end wall.

6. A collapsible container comprising:

a rectangular bottom wall;

two opposed vertical side walls;

two opposed vertical end walls;

hinge means for pivotally and releasably attaching said side and end walls to said bottom wall, said side and end walls pivotable between an erected position generally perpendicular to said bottom wall and a collapsed position generally parallel to and overlying said bottom wall; and corner joint means for locking said side and end walls in said erected position, said corner joint means including each said side wall having a groove formed on an exterior surface adjacent a vertically extending edge and each said end wall having a first flange extending generally parallel with said side wall, a second flange extending inwardly from said first flange and engageable within said groove, and a third flange having a surface generally parallel to said second flange engaging a corner edge of said side wall with a ridge formed on said surface to releasably lock said side and end walls in said erected position.

7. The collapsible container of claim 6, wherein said groove, second flnage and ridge extend along at most an upper half of said vertically extending edge.

8. The collapsible container of claim 6, wherein said hinge means further comprises:

a first one of said walls having a first hinge portion with an integrally formed pivot pin adjacent an edge and a second one of said walls having a cooperating second hinge portion, adjacent said first hinge portion, with an integrally formed, semi-cylindrical surface, said semi-cylindrical surface defining an aperture of sufficient size to allow said pivot pin to pass radially through said aperture into engagement with said semi-cylindrical surface.

9. The collapsible container of claim 8, wherein said second hinge portion further comprises:

an integrally formed projection disposed adjacent said semi-cylindrical surface along a periphery of said second one of said walls, said projection movable out of axial alignment with said semi-cylindrical surface to permit insertion of said pivot pin and returnable into axial alignment with said semi-cylindrical surface to releasably secure said first one of said walls in pivotal relation to said second one of said walls.

10. The collapsible container of claim 9, wherein said projection further comprises:

a curved surface on said projection radially opposite from said semi-cylindrical surface and longitudinally spaced along said periphery of said second one of said walls from said semi-cylindrical surface, said curved surface and semi-cylindrical surface defining a pivot-pin-receiving aperture.

11. The collapsible container of claim 8, wherein said first one of said walls comprises said side and end walls, and said second one of said walls comprises said bottom wall.

12. The collapsible container of claim 8, wherein at least two first hinge portions are disposed along each bottom edge of said side and end walls adjacent said bottom wall, and at least two second hinge portions are disposed along each side of said rectangular bottom wall.

13. The collapsible container of claim 8, wherein said side walls are disposed overlying said bottom wall and said end walls are disposed overlying said side walls in said collapsed position.

14. A collapsible container comprising:

a rectangular bottom wall;

two opposed vertical side walls;

two opposed vertical end walls;

hinge means for pivotally and releasably attaching said side and end walls to said bottom wall, said side and end walls pivotable between an erected position generally perpendicular to said bottom wall and a collapsed position generally parallel to and overlying said bottom wall; and corner joint means for locking said side and end walls in said erected position, said corner joint means including each said side wall having a groove formed on an exterior surface adjacent a vertically extending edge and each said end wall having a first flange extending generally parallel with said side wall, a second flange extending inwardly from said first flange and engageable within said groove, and a third flange having a surface generally parallel to said second flange engaging a corner edge of said side wall with a ridge formed on said surface to releasably lock said side and end walls in said erected position, wherein said groove, second flange and ridge extend along at most an upper half of said vertically extending edge, and a remaining lower portion of said vertically extending edge having a fourth flange formed on said end wall extending generally parallel to said side wall, wherein said side wall abuts against an interior surface of said fourth flange to prevent outward bulging of said remaining lower portion of said side wall beyond said end wall.

15. A collapsible container comprising:

a rectangular bottom wall;

two opposed vertical side walls;

two opposed vertical end walls;

hinge means for pivotally and releasably attaching said side and end walls to said bottom wall, said side and end walls pivotable between an erected position generally perpendicular to said bottom wall and a collapsed position generally parallel to and overlying said bottom wall, said hinge means including each side and end wall having a first hinge portion with an integrally formed double pivot pin adjacent a bottom edge, said double pivot pin having outwardly extending, cylindrical projections generally parallel to said bottom edge integrally formed with a tab connecting said double pivot pin to each respective side and end walls, and each side and end wall having a corresponding cooperating second hinge portion, adjacent said first hinge portion, with an integrally formed pair of semi-cylindrical surfaces peripherally spaced from each other along an edge of said rectangular bottom wall, said semi-cylindrical surfaces each defining an aperture of sufficient size to allow said cylindrical projection of said double pivot pin to pass radially through said aperture into engagement with said semi-cylindrical surface; and corner joint means for locking said side and end walls in said erected position, said corner joint locking means including said side wall having a groove formed on an exterior surface adjacent a vertically extending edge and said end wall having a flange extending generally parallel with said side wall, a second flange extending inwardly from said first flange and engageable within said groove, and a third flange having a surface generally parallel to said second flange engaging a corner edge of said side wall with a ridge formed on said surface to releasably lock said side and end walls in said erected position.

16. The collapsible container of claim 11, wherein said second hinge portion further comprises:

an integrally formed projection disposed between said pair of semi-cylindrical surfaces, generally aligned with said tab, said projection having a curved surface coaxial with said semi-cylindrical surfaces, radially opposite from said semi-cylindrical surfaces and longitudinally offset from said semi-cylindrical surfaces, said curved surface and said pair of semi-cylindrical surfaces defining a pivot-pin-receiving aperture, said projection movable out of axial alignment with said semi-cylindrical surfaces to permit insertion of said pivot pin and returnable into axial alignment with said semi-cylindrical surfaces to releasably secure said bottom wall in pivotal relation to said respective side and end walls.

17. The collapsible container of claim 15, wherein said side walls are disposed overlying said bottom wall and said end walls are disposed overlying said side walls in said collapsed position.

18. The collapsible container of claim 15, wherein said groove, second flange and ridge extend along at most an upper half of said vertically extending edge.

19. The collapsible container of claim 18, further comprising:

a remaining lower portion of said vertically extending edge having a fourth flange formed on said end wall extending generally parallel to said side wall, wherein said side wall abuts against an interior surface of said fourth flange to prevent outward bulging of said remaining lower portion of said side wall beyond said end wall.

* * * * *